US005301578A

United States Patent [19]

Fromson

[11] Patent Number: 5,301,578

[45] Date of Patent: Apr. 12, 1994

[54] METHOD AND APPARATUS FOR CUTTING A CONTINUOUS MATERIAL TO LENGTH

[76] Inventor: Howard A. Fromson, 49 Main St., Stonington, Conn. 06378

[21] Appl. No.: 77,890

[22] Filed: Jun. 15, 1993

Related U.S. Application Data

[63] Continuation of Ser. No. 868,615, Apr. 14, 1992, abandoned.

[51] Int. Cl.[5] ..... B26D 1/09

[52] U.S. Cl. ..... 83/42; 83/214; 83/236; 83/517; 83/519; 83/649; 83/949

[58] Field of Search ..... 83/214, 213, 42, 937, 83/949, 516, 517, 519, 39, 649, 618, 620, 622, 425.2, 236, 262, 622

[56] References Cited

U.S. PATENT DOCUMENTS

| | | | |
|---|---|---|---|
| 1,620,354 | 3/1927 | Jones et al. | 83/622 X |
| 2,710,565 | 6/1955 | Schroeder | 83/236 X |
| 3,177,749 | 4/1965 | Best et al. | 83/714 X |
| 4,041,818 | 4/1977 | Rummer | 83/517 X |
| 4,092,925 | 6/1978 | Fromson | 101/369 X |
| 4,656,857 | 4/1987 | Tomita | 83/236 X |
| 4,708,624 | 11/1987 | Ligon | 83/620 X |
| 5,099,671 | 3/1992 | Beaulac | 83/214 X |

*Primary Examiner*—Richard K. Seidel
*Assistant Examiner*—Kenneth E. Peterson
*Attorney, Agent, or Firm*—Felfe & Lynch

[57] ABSTRACT

A method and apparatus for cutting continuous material to length. Lithographic printing plates are cut from a substantially continuous lithographic aluminum web by a plurality of aligned shear units displaced from each other longitudinally along the web.

6 Claims, 1 Drawing Sheet

METHOD AND APPARATUS FOR CUTTING A CONTINUOUS MATERIAL TO LENGTH

Figure 1:
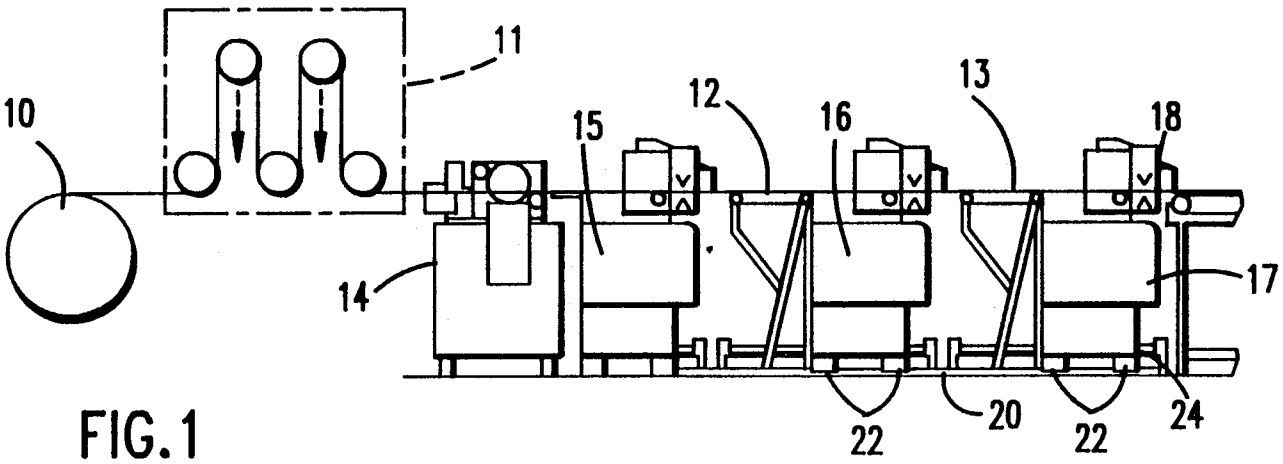

This application is a continuation of application Ser. No. 07/868,615 filed Apr. 14, 1992, now abandoned.

This invention relates to a method and apparatus for cutting from a continuous length of material, especially a continuous web of sheet material.

When cutting from a production line of continuous material using fixed as opposed to flying cutting means, and where the cutting time cannot be virtually instantaneous, the material must be accumulated in some manner immediately prior to the cutting step and then indexed and fed at the desired length into the cutting operation. The material transport means used for feeding the cutting means may be capable of a top speed that is substantially higher than its average actual speed because of the acceleration-deceleration required in the feeding of each length to be cut.

This invention includes feeding, in a single indexing, a length of continuous material which is some multiple of the desired cut length to a plurality of cutters in series. By running the transport means longer one obtains the benefit of averaging each acceleration-deceleration cycle over more than one cut piece and also permits the material transport means to more closely approach, or run for a longer time at, its top speed.

The invention is particularly directed to a method and apparatus for increasing the speed of an operation for cutting lithographic printing plates from a continuous or semi-continuous web. Prior to this invention, the feed of a substantially continuous aluminum web to a cutting operation has been indexed through a web feeder to one shearing unit. The length of the feed to the shearing unit determines the length of the material cut. For lithographic printing plates, the usual length fed to the cutter is from two to three feet.

It is an object of this invention to provide a new and improved method and apparatus for cutting predetermined lengths from a continuous length of material.

It is also an object of the invention to provide a new and improved method and apparatus for making a lithographic printing plate which avoids one or more of the disadvantages of prior such methods and apparatus.

It is another object of the invention to provide a new and improved method and apparatus for cutting lithographic printing plates which operates at a higher speed of operation than prior methods and apparatus.

Although the invention will be described in detail in the context of cutting a continuous length of aluminum web to lengths suitable for printing plates, it should be understood that the apparatus and method described are suitable for cutting-to-length from any continuous or semi-continuous material.

In accordance with the invention, a method of cutting lithographic printing plates to length comprises providing a continuous or semi-continuous web of lithographic aluminum with a slack length or otherwise accumulating a desired length of the continuous web to feed to the cutting operation. The method also includes feeding a desired length of the accumulated web from the slack length to a longitudinal conveyor. The method also includes cutting the length fed by a plurality of aligned shear units displaced from each other longitudinally along the fed portion of the web. The method also includes preferably timing the cutting such that the first cut is made by the shear unit farthest from the feed unit and the last cut is made by the shear unit nearest the feed unit after the web feed has been completed, such that the distance between cuts of the web is precisely determined as desired.

Also in accordance with the invention, apparatus for cutting a continuous web of lithographic aluminum to printing plate length comprises means for providing a continuous or semi-continuous lithographic web and means for accumulating a desired length of the web to be fed to the cutting unit. The apparatus also comprises a longitudinal conveyor and means for feeding the web from the accumulated length to the conveyor. The apparatus also includes a plurality of aligned shear units displaced from each other. One shear unit is disposed between the feed unit and the conveyor and one or more additional shear units are disposed further along the conveying means for cutting the web. The apparatus also includes means for so timing the cutting after the feed unit has fed the desired web length that the first cut is made by said additional shear unit which is farthest displaced from the feed unit, the second cut is made by the immediately preceding shear unit and so on, with the last cut being made by the shear unit which is nearest the feed unit.

For a better understanding of the present invention, together with other and further objects thereof, reference is made to the following description, taken in connection with the accompanying drawings.

Figure 2:
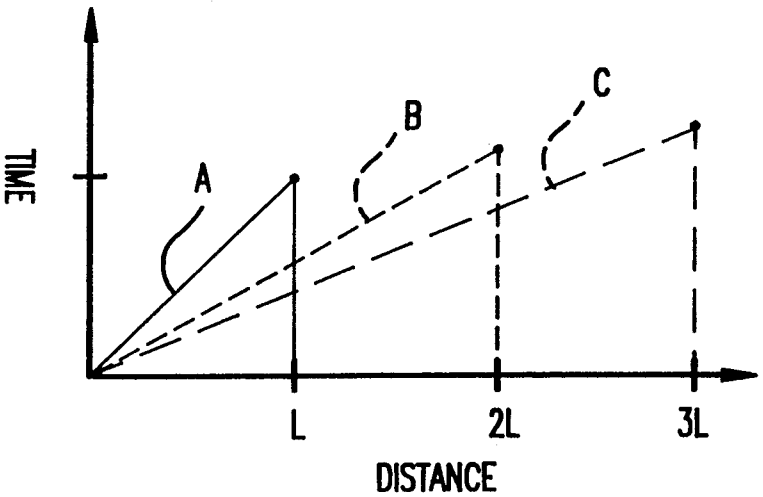

Referring now to the drawings:

FIG. 1 is a schematic diagram of apparatus for cutting material to length in accordance with the invention; and FIG. 2 is a distance-time graph comparing the operation of apparatus constructed in accordance with the invention with prior apparatus.

Referring now more particularly to FIG. 1, apparatus for cutting lithographic aluminum comprises means for providing a continuous or semi-continuous web which may, for example, be a composite coil 10 of lithographic aluminum and a carrier of the type described in my U.S. Pat. No. 4,092,925 or a continuous web of aluminum exiting a processing line. The apparatus includes means for accumulating a sufficient length of material to feed the cutting operation. In this case, an accumulator 11 is shown. The apparatus also includes longitudinal conveyors 12 and 13 which are preferably adjustable conveyors. The apparatus also includes means for feeding the web from accumulator 11 to the conveyors comprising a conventional feed unit 14.

The apparatus also includes a plurality of aligned shear units 15, 16 and 17 displaced from each other. Shear unit 15 is disposed between feed unit 14 and conveyor 12, shear unit 16 is disposed after conveyor 12 and shear unit 17 is disposed after conveyor 13. Shear units 16 and 17 are preferably longitudinally displaceable and as shown are mounted on a linear motion trackway 20 and equipped with positive locking hold downs 22. Precision linear motion adjusting screws 24 are also preferred, permitting fine longitudinal adjustment of shear unit location.

The apparatus also includes means (not shown) for so timing the cutting that the first cut is made by shear unit 17, the unit farthest from feed unit 14, the second cut is made by shear unit 16, the unit next closest to feed unit 14, and the final cut is made by shear unit 15.

The apparatus preferably also includes a conveyor 18 for conveying cut pieces of the web away from the cutting station.

Considering now the operation of the apparatus, composite coil or line feed 10 continuously provides a lithographic aluminum web or other material and accumulator 11 collects enough of the web to meet the demand of feed unit 14. Feed unit 14 feeds the web from accumulator 11 to longitudinal conveyors 12 and 13 which preferably are adjustably positioned. Aligned shear units 15, 16 and 17 sequentially cut the web, such that the first cut is made by shear unit 17, which is farthest displaced from feed unit 14, the second cut is made by shear unit 16, and the last cut is made by shear unit 15, the unit nearest feed unit 14.

In prior known cutting apparatus, the feed unit spent substantially its entire operating time either accelerating or decelerating. In other words, the web never or only briefly traveled at the maximum speed of the feed unit. In accordance with the present invention, with three cuts being made at approximately the same time from a single feed, the feed unit accelerates and decelerates only one-third the number of times and operates at maximum speed for a significant portion of its operating time. This gives the result that the time for feeding a length three times the ultimate desired length may be significantly less than the time required to individually feed three separate final lengths, as represented in FIG. 2. In FIG. 2, Curve A represents the time-distance characteristic of prior apparatus. Curves B and C respectively represent the time-distance characteristic of apparatus in accordance with the invention employing two shear units and three shear units.

The ultimate number of cutting units employed in any specific application would require a balancing of plant layout, capital investment, line speed of any process operations preceding the cutting step and the like.

I claim:

1. Apparatus for cutting lithographic printing plates from an aluminum web comprising:

(a) means for providing a source of a substantially continuous web of lithographic aluminum;

(b) means for accumulating a length of said web which is at least a multiple of the desired plate length;

(c) means for feeding from said accumulating means a web length which is a multiple of the desired plate length; and (d) a plurality of serially-disposed cutting means for cutting said material at length separated by a distance equal to said desired plate length.

(e) means for controlling said cutting means such that the cutting proceeds sequentially from the cutting means farthest from the feeding means to the cutting means closest to said feeding means.

2. The apparatus of claim 1 in which said cutting means are shear units.

3. The apparatus of claim 2 in which the distance between said shear units is adjustable.

4. A method of cutting lithographic printing plates from an aluminum web comprising the steps:

(a) providing a source of a substantially continuous web of lithographic aluminum;

(b) accumulating a length of said web that is at least a multiple of a desired lithographic printing plate length to be cut from said web;

(c) feeding a length of said accumulated web which is a multiple of the desired plate length to a serially-disposed plurality of cutting means for cutting said material to length; and (d) cutting the web to length with said cutting means, said cutting being timed such that the cutting proceeds sequentially from the cutting means farthest from the source of the continuous web to the cutting means closest to the source of the continuous web.

5. A method of cutting lengths of sheet material from a continuous web of sheet material, said method comprising (a) providing a source of substantially continuous web of sheet material;

(b) accumulating a length of said web that is at least a multiple of a desired length to be cut from said web;

(c) feeding a length of said accumulated web which is a multiple of the desired length to a serially-disposed plurality of cutting means for cutting said material to length; and (d) cutting the web to length with said cutting means, said cutting being timed such that the cutting proceeds sequentially from the cutting means farthest from the source of the continuous web to the cutting means closest to the source of the continuous web.

6. Apparatus for cutting lengths of sheet material from a continuous web of sheet material, said apparatus comprising (a) means for providing a source of a substantially continuous web of sheet material;

(b) means for accumulating a length of said web which is at least a multiple of the desired length;

(c) means for feeding from said accumulating means a web length which is a multiple of the desired length;

(d) a plurality of serially-disposed cutting means for cutting said material to length separated by a distance equal to said desired length; and (e) means for controlling said cutting means such that the cutting proceeds sequentially from the cutting means farthest from the feeding means to the cutting means closest to said feeding means.

* * * * *